United States Patent [19]

Wolfe

[11] 3,961,511

[45] June 8, 1976

[54] METAL DRAWING MIXTURE

[76] Inventor: John W. Wolfe, 323 North St., McDonald, Pa. 15057

[22] Filed: Jan. 9, 1975

[21] Appl. No.: 539,727

[52] U.S. Cl. ..... 72/42

[51] Int. Cl.[2] ..... B21C 9/00

[58] Field of Search ..... 72/41, 42, 46; 252/22, 252/23

[56] References Cited

UNITED STATES PATENTS

| | | | |
|---|---|---|---|
| 159,610 | 2/1875 | Reynolds et al. | 72/42 |
| 804,455 | 11/1905 | Comstock | 252/22 |
| 1,739,631 | 12/1929 | Cross | 252/23 |
| 2,318,614 | 5/1943 | Leonard | 72/42 |
| 2,319,393 | 5/1943 | Epstein et al. | 72/42 |
| 2,335,933 | 11/1943 | Goheen et al. | 72/42 |
| 2,393,675 | 1/1946 | Fenner et al. | 72/42 |
| 2,531,553 | 11/1950 | Canney | 252/23 |

*Primary Examiner*—C. W. Lanham
*Assistant Examiner*—E. M. Combs
*Attorney, Agent, or Firm*—Parmelee, Miller, Welsh & Kratz

[57] ABSTRACT

An improved metal surface and die protecting lubricating dry-drawing mixture, substantially in the form of a powder, is provided and is applied to the surface of a cleaned and an alkaline coated metal or steel workpiece such as a rod or wire. It serves to eliminate the need for a metal draw coating and to eliminate limitations in previous drawing procedures from the standpoint of speed and maximized amount of total draw reduction.

8 Claims, 2 Drawing Figures

METAL DRAWING MIXTURE

BACKGROUND OF THE INVENTION

1. Field of the Invention

This invention pertains particularly to a drawing mixture which is suitable for rigorous utilizations involving maximum reductions and pass speeds, and also to an improved drawing procedure and utilization of drawing lubricants. A phase of the invention deals with a dry lubricating type of drawing mixture that has a proportioned content in a mixed relation and whose ingredients serve in a complementary highly improved manner to protect the surface of a metal workpiece being drawn under strenuous conditions.

2. Description of the Prior Art

Various types of dry and wet lubricating compounds and mixtures have been used in the drawing of metal workpieces, such as steel, and in drawing high carbon and specialty steel material into wire or rod lengths. There has been a somewhat general adoption of a method which involves the application of a dip-applied lead coating to the workpiece to which is applied ordinary soap powder at the entrance to each draw die. In this connection, a cleaned rod, for example, is dipped to provide the lead coating and is then passed through a requisite number of dies to produce the desired final or semi-final product. In utilizing such a coating, it is important to control the speed so as to prevent a rise of temperature to near the melting point of the coating which in the case of lead is around 621° F. Also, as the drawing progresses, the coating tends to become thinner and less effective thus limiting the percentage of reduction during continuation of the operation. For a less stringent type of operation, where the workpiece is not quite so hard or brittle a material, a modified form of coating is provided which utilizes an acid salt and may include a drawing compound in the nature of a sodium resin silicate.

It has been my experience that the present types of drawing or lubricating methods have all been of a production limiting nature, and although rejects have been reduced from about 50% to possibly 30% at the present time, the percentage is so great as to make the resultant product relatively expensive. Also, restrictions on the speed of operation, as well as the percentage reduction, have been limitations which have increased the cost of a product and made it relatively expensive. Also, restrictions on the speed of operation, as well as the percentage reduction, have been limitations which have increased the cost of a product such as welding rod, rope and bridge wire, music spring and valve spring wire, binding wire, etc.

SUMMARY OF THE INVENTION

It has thus been an object of the present invention to devise an improved drawing procedure which will be particularly useful in drawing relatively hard metal workpieces, such as involved in drawing nickel, chromium, manganese, molybdenum, vanadium and tungsten steel workpieces.

A further object has been to provide an improved drawing mixture of a lubricating type that will stand up under extreme rigorous usage from the standpoint of drawing speed, temperature and overall starting rod to final fine wire reduction that have heretofore been restrictive factors using conventional material and methods.

A still further object of the invention has been to provide an improved lubricating mixture that will enable a greatly increased efficiency with a minimum of rejects in drawing relatively hard metal, such as stainless and other ferro alloys containing hardening material of the nature of nickel, chromium, molybdenum, tungsten, etc.

These and other object of the invention will appear to those skilled in the art from the illustrated embodiments and the claims.

DESCRIPTION OF THE PREFERRED EMBODIMENT

In carrying our the invention, a lubricating or drawing mixture has been devised which is made up of three essential ingredients, namely, soap powder, powdered fire clay and powdered graphite. A suitable industrial grade of soap powder is being made and sold by Diamond Shamrock Corporation. It is preferable to employ the fire clay and the graphite in a relatively very fine condition. A graphite such as used for home lubricating purposes instead of oil is suitable. The soap powder may be of a coarser nature up to granular form. A good mixture is represented by one containing granules that will pass a screen having about twenty openings or squares per inch.

An important discovery of the invention involves the use of fire clay which is normally considered as a somewhat abrasive material. It has been found that it has an important effect in preventing the breakdown of the graphite such as would otherwise tend to cause it to scratch the workpiece, burst the die, etc.

The exact action which occurs is not known, but the use of a substantially equally proportioned minor quantity by weight of soap and graphite powders and a major quantity by weight of fire clay powder in a fully miscible relation provides a type of mixture that greatly exceeds the protection given by a lead coating and that is outstanding in its operating characteristics. In this connection, the ratios may be, for example, 6 ounces to a pound of soap powder and 6 ounces to a pound of graphite powder, with about 5 to 15 pounds of fire clay powder. It will be noted that the ratio of soap powder to graphite should be substantially equal. The mixture is thoroughly stirred before use and is applied to the workpiece at the entrance of each die pass.

The workpiece is first pickled or suitably cleaned as by an acid dip to remove scale and other extraneous material, the acid drag-out is washed off, and the workpiece is then coated with suitable alkaline material, such as lime. Slacked or hydrated lime may be applied by passing the workpiece through a tank containing a hot milk (190° F. to 200° F) with sufficient retention to bring the workpiece up to bath temperature. The coating is then dried thereon by baking, as by passing the workpiece through a chamber containing infrared lights or hot air. The lime serves to neutralize the acid pickle, to protect the clean surface from the atmosphere and to aid in the pick-up of the lubricating mixture of the invention. A neutral salt or a sodium resin silicate coating, may if desired, be applied before the alkaline coating to reinforce it. The alkaline coating may be sodium borate or, as an optimum, milk of lime.

Figure 1:
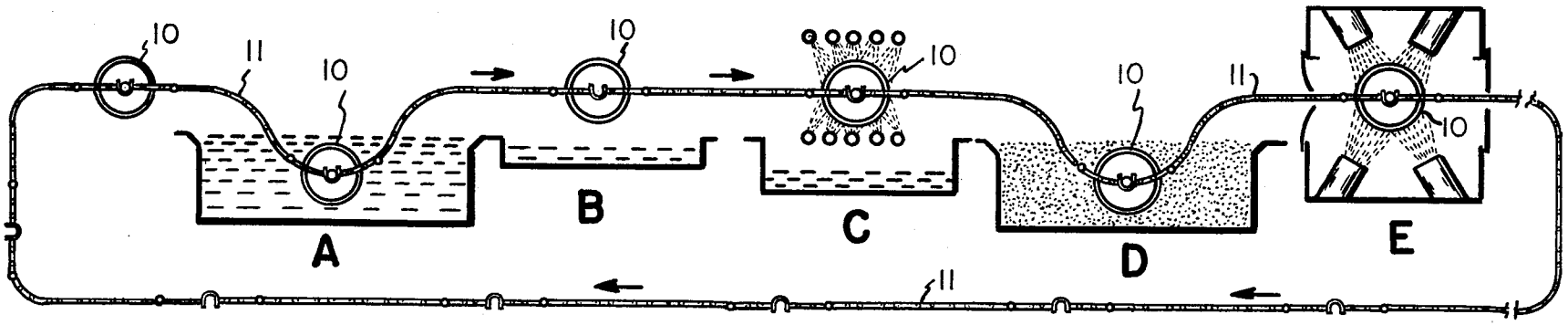
FIGS. 1 and 2 are somewhat schematic layouts showing a typical drawing line utilizing principles of the invention and particularly, utilizing the lubricating mixture of the invention.
Figure 2:
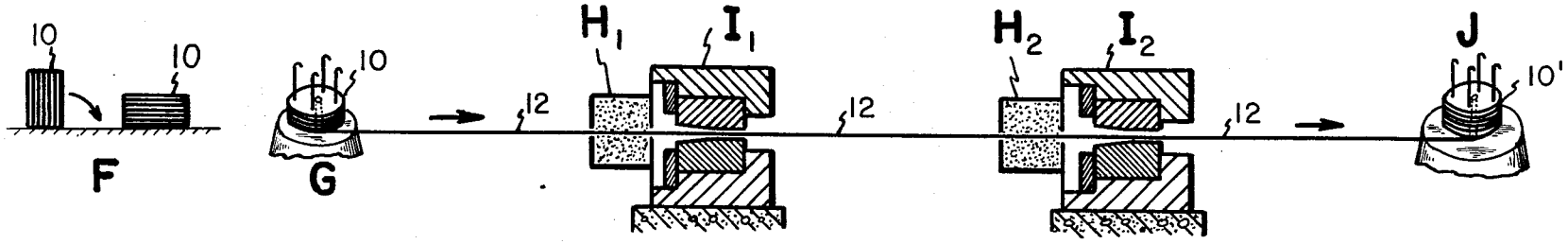

In carrying out the invention, it is important that adhering scale, oxide and dust be removed from the metal workpiece before the drawing operations. For example, hot sulfuric acid may be employed as a pickle, followed, as shown in FIG. 1, by a high-pressure water rinse. Subsequently the cleaned workpiece is then coated as by dipping within a lime bath or solution and baked to dryness. As pointed out above, the lime coating not only serves to protect the clean surface from rusting, to neutralize any remaining traces of acid but also, importantly, serves as a carrier for the drawing lubricant.

It has been determined that the placing of a small quantity of the mix of the invention in a box ahead of or at the entrance to a die through which the workpiece has to move will assure a sufficient pick-up of the mix to fully protect the surface of the workpiece, as well as the die, and assure a highly improved drawing operation. A good optimum working mixture is represented by about one pound of commercial industrial soap powder and an equal weight of graphite powder and about nine pounds of powdered fire clay. A partial somewhat poor substitute for the graphite is represented by powdered molybdenum sulfate, with greater (about one and a half times) proportioning being required. The substitution should be limited to a maximum of about 25% of the total graphite requirement in the mixture. It will be noted that the major weight content of the mixture represented by the dry fire clay powder represents about 5 to 7.5 times the combined weight content of the dry soap and graphite powders. The fire clay may be of a type such as used in making of conventional silicon or fire clay brick, having a range of approximately 41% to 77% of silica (silicon oxide), 15% to 40% of alumina (aluminum oxide), with minor amounts of about 0.96 to 2.8% of titania (titanium oxide), 0.10% to 1.80% of alkalies (such as calcium oxide), 0.01 to 1.01% of magnesia (magnesium oxide), 0.50 to 5.8% of iron oxide (ferric oxide), and about 0.01 to 3.0% of other alkalies. A clay of the so-called flint or semi-plastic flint type has been found to be best suited by reason of its more refractory nature. The complete mixture has a somewhat grayish-blackish coloration and, on the surface of a typical ferrous metal workpiece after a drawing pass, produces a somewhat blackish, enamel-like smooth, high gloss appearance. Upon the completion of the drawing steps, it serves as a protective surface for the product and may be removed, if desired, in any conventional manner as by pickling.

As distinguished from a lead coating which tends to thin during the operation, to melt-off due to the temperature engendered by the drawing, and to require subsequent removal after the completion of the drawing operation, the present drawing mixture, as above pointed out, may be retained or easily removed. There is no loss such as involved in applying, and then removing and discarding a lead coating.

By way of example, I have successfully utilized a drawing mixture of the invention in producing alloy steel rods from typical high chromium and nickel grades of stainless steel, such as for example, types 309, 310, 348, etc. In this connection, I have been able to reduce rod on a continuous operating basis from about 0.218 to 0.093 of an inch in four double passes with substantially no rejects of the workpiece or damage to the dies. As far as I have been able to determine, down to about 0.124 of an inch is about the minimum that can be successfully accomplished using a lead dip coating. Drawing using the mix of the invention may be effected at a full rheostat, for example, at a rate of 500 ft. per minute, without the previous maximum limitation of approximately 50 to 100 feet (35 feet per minute optimum) as applied to a hard alloy steel workpiece having a lead coating. In fact, a tandem fast line having a speed of 1000 ft. per minute with about 2 feet spacing between five dies may be successfully employed, provided that the rod is moved through a lubricating mix of the invention before entering each die pass. The lack of die wear and tear is noteworthy. The as-drawn surface is also conducive to the extrusion application of a flux coating such as used for a welding rod.

It is important that the mixture be applied and used as a dry (powder) mixture and on a dry surface of the workpiece base or rod metal material or workpiece being drawn. There is no longer any need for melting-off a lead coating before re-annealing the steel for completing a required draw reduction. Although it is advantageous to apply a mixture by running the workpiece through a box containing it ahead of each die, it has been determined that one application may be employed to, first cold die-reduce a hard steel alloy rod workpiece containing, for example, 30% chromium and 8.5% nickel, from 0.281 to 0.245 of an inch, and then second pass cold die-reduce it to 0.207 of an inch, without damage to the die or the workpiece. However, it is preferable to pass the workpiece through the mixture ahead of each draw pass of cold die reduction step.

Using the mixture of the invention, I have successfully reduced 0.281 of an inch rod workpiece to 0.120 of an inch within three die passes. Using a rate of 50 to 75 feet per minute for a lead coated surface in an eight hour run may, for example, result in about three broken dies. Using the mixture of the invention and increasing the speed to 300 feet per minute, there was no die breakage using the same above type of workpiece in the eight hour period and the production rate was doubled. In other words, it is now possible using the invention to successfully produce as much drawn material in four hours as heretofore requiring eight hours. Further, there is no build-up of lead on the dies which in time tends to cause freezing.

In accordance with accepted procedure, cleaning of the surface of the rod or other workpiece may be in a solution of hot dilute sulfuric or hydrochloric acid for a period of ten to thirty minutes. Care must be taken to avoid marring the surface of the workpiece during the drying operation or of introducing moisture into the drawing mixture of the invention. It appears from a study of the drawn surface that the alumina-silicon content of the fire clay combines with the graphite content to produce a blackish glassine protective surface film that lacks the brittleness of glass per se, that has a toughness that is induced by the graphite, and a smoothness that is enhanced by greasiness of sodium salts of the fatty acids of the soap content.

By way of representation, FIG. 1 makes use of a rod-like length of steel workpieces. Such a line may be used in accomplishing a drawing procedure in accordance with the invention utilizing the drawing composition thereof. One or more rod coils as wound on a drum or reel 10 may be positioned on a continuous, chain-like conveyor 11 and moved or advanced from an acid pickling bath A over a drip collecting bath or tank B, and through a spray station C at which wash water may be applied at high pressure to rinse off pickling drag-out on the surface of the workpiece carried on the drum or reel 10. At station C, a tank is, as shown, positioned beneath the spray applicators to collect the run-off. The conveyor 11 is shown as thereafter carrying the reel 10 through a hot lime dip at station D and thence into a baking oven station E. At station E, the lime coating is solidified and dried on the surfaces of the workpiece.

After the above preliminary operations, the reel 10 may be turned from a horizontal to a vertical position at station F and then mounted in a stationary position at station G for rotative pay-out of a length of workpiece 12 therefrom, progressively and successively through a series of draw dies represented by $I_1$ and $I_2$. Lubricating mixture of the invention is shown applied at stations $H_1$, $H_2$ ahead of the introduction of the workpiece 12 through representative dies $I_1$ and $I_2$. When the requisite draw-reduction of the workpiece length 12 has been accomplished, it then may be rewound or re-reeled on a rotative, vertically-extending reel 10' at station J. Subsequential treatment may be of any conventional type for obtaining requisite characteristics of the workpiece for its final stage.

I claim:

1. An improved method of die-drawing a relatively hard metal workpiece which comprises, cleaning the surface of the workpiece and applying an adherent dried-on alkaline coating thereto, providing a dry miscible powder containing substantially equally proportioned minor quantities of soap and graphite powders and a major quantity of fire clay powder, applying the dry miscible powder to and adhering it on the alkaline coating, and thereafter forming a protective surface film on and reducing the workpiece by moving it through a draw die with the miscible powder thereon.

2. An improved method as defined in claim 1 wherein the miscible powder is prepared on a proportioned basis of about 0.5 to 1 lb. each of soap and graphite powders, and about 5 to 15 lbs. of powdered fire clay.

3. An improved method as defined in claim 1 wherein, the alkaline coating is formed by applying milk of lime at a raised temperature on the cleaned surface of the metal workpiece, and by thereafter drying the lime on the surface.

4. An improved method as defined in claim 3 wherein, the workpiece is cold-drawn through a series of dies of progressively lesser diameters, and the miscible powder is applied to the surface of the workpiece before it is introduced into each die.

5. An improved method as defined in claim 2 wherein, the alkaline coating is formed by applying hot liquid lime to the cleaned surfaces while the surfaces are brought up to a temperature of about 190° F., to 200° F., and the liquid lime is thereafter baked on the surfaces.

6. An improved method as defined in claim 1 wherein a somewhat grayish glassy type of coating is imparted to the surfaces of the workpiece by the draw die.

7. An improved method of effecting a stepped reduction in the diameter of a hard metal rod which comprises, acid pickle-cleaning the rod to remove scale and dirt therefrom, applying a lime coating in liquid form to the cleaned surface and drying it thereon, advancing the rod through a series of cold reducing dies, and before passing the rod through each die, applying a powdered mixture in a dry condition to the lime coated surface thereof which consists of a substantially equally proportioned minor quantity of soap and graphite powders and a major quantity of fire clay powder.

8. An improved method of drawing a hard metal workpiece which comprises, cleaning the surface of the workpiece, applying milk of lime and drying it as a preliminary coating on the cleaned surface, forming a dry powder mixture of a substantially equally proportioned minor weight content of dry soap and graphite powders and a major weight content of dry fire clay powder that is about five to seven and one-half times the combined weight content of the soap and graphite powders, applying the powder mixture in a dry condition on the surface of the preliminary coating, and thereafter moving the workpiece with the dry powder mixture thereon through a cold draw pass and substantially simultaneously reducing its thickness and forming a smooth glassy-like surface coating thereon.

* * * * *